US007273111B2

(12) United States Patent
Johnson

(10) Patent No.: US 7,273,111 B2
(45) Date of Patent: Sep. 25, 2007

(54) GRADING IMPLEMENT

(76) Inventor: Glen Johnson, 20455 Huntington Way, Prior Lake, MN (US) 55372

( * ) Notice: Subject to any disclaimer, the term of this patent is extended or adjusted under 35 U.S.C. 154(b) by 0 days.

(21) Appl. No.: 10/781,972

(22) Filed: Feb. 19, 2004

(65) Prior Publication Data

US 2004/0244233 A1 Dec. 9, 2004

Related U.S. Application Data

(60) Provisional application No. 60/448,766, filed on Feb. 20, 2003.

(51) Int. Cl.
*A01B 15/00* (2006.01)

(52) U.S. Cl. ..... 172/684.5; 172/787; 37/268; 37/231

(58) Field of Classification Search ..... 172/684.5, 172/817, 811, 787; 37/266, 268, 264, 235, 37/231

See application file for complete search history.

(56) References Cited

U.S. PATENT DOCUMENTS

| | | | | | |
|---|---|---|---|---|---|
| 290,410 | A | * | 12/1883 | Faulkner | 172/684.5 |
| 476,691 | A | * | 6/1892 | Shuart | 172/684.5 |
| 1,164,142 | A | * | 12/1915 | Sutton | 172/684.5 |
| 1,368,585 | A | * | 2/1921 | Vigil | 172/684.5 |
| 1,487,723 | A | * | 3/1924 | Corbitt | 172/684.5 |
| 3,058,243 | A | * | 10/1962 | McGee | 172/197 |
| 3,672,521 | A | | 6/1972 | Bauer et al. | |
| 3,732,996 | A | | 5/1973 | Bauer | |
| 4,044,843 | A | * | 8/1977 | Holub | 172/825 |
| 4,572,301 | A | * | 2/1986 | Bourgeois, Jr. | 172/445.1 |
| 4,655,297 | A | * | 4/1987 | Bourgeois, Jr. | 172/445.1 |
| 4,892,155 | A | * | 1/1990 | Wanamaker | 172/199 |
| 4,936,392 | A | | 6/1990 | Kitchin | |
| 5,127,172 | A | | 7/1992 | Lund et al. | |
| 5,172,499 | A | * | 12/1992 | Griffin | 37/407 |
| 5,191,943 | A | * | 3/1993 | Minor et al. | 172/393 |
| 5,562,397 | A | | 10/1996 | Albright | |
| 5,680,715 | A | * | 10/1997 | Thiboutot et al. | 37/219 |
| 5,701,693 | A | | 12/1997 | Brocious et al. | |
| 5,775,438 | A | | 7/1998 | Confoey et al. | |
| 5,794,714 | A | * | 8/1998 | Brown | 172/799.5 |
| 5,974,706 | A | | 11/1999 | Kaczmarski et al. | |
| 5,983,535 | A | | 11/1999 | Kaczmarski et al. | |
| 6,035,562 | A | | 3/2000 | Virnig et al. | |

(Continued)

OTHER PUBLICATIONS

*The Contractors Choice*, vol. 1, Issue 8, 36 pages (Jan. 2003).

(Continued)

*Primary Examiner*—Thomas A. Beach
(74) *Attorney, Agent, or Firm*—Merchant & Gould P.C.

(57) ABSTRACT

A grading implement including main body having a left end, a right end and a length that extends between the left and right ends. The main body also includes a front side and a back side. A claw-blade is positioned at the front side of the main body. Side blades are positioned at the left and right ends of the main body. The side blades include portions that extend rearwardly from the main body so as to define a volume located behind the back side of the main body between the side blades. The volume receives grading material when the implement is moved rearwardly.

30 Claims, 17 Drawing Sheets

U.S. PATENT DOCUMENTS

| | | | | |
|---|---|---|---|---|
| 6,085,848 | A * | 7/2000 | Sanders | 172/684.5 |
| 6,238,130 | B1 | 5/2001 | Youngers | |
| 6,283,225 | B1 | 9/2001 | Hermonson | |
| 6,499,934 | B1 | 12/2002 | Kaczmarski et al. | |

OTHER PUBLICATIONS

Skid Steer Loaders, http://www.casece.com/products/attachment.asp?RL=NAE&id=24&Industry=, 2 pages (2003).

* cited by examiner

GRADING IMPLEMENT

CROSS REFERENCE TO RELATED APPLICATION

This application claims the benefit of U.S. Provisional Patent Application No. 60/448,766 filed Feb. 20, 2003, which application is incorporated herein by reference in its entirety.

TECHNICAL FIELD

The present invention relates generally to excavation devices. More particularly, the present invention relates to blades for use with vehicles such as skid steer loaders.

BACKGROUND

A wide variety of vehicles exist for moving earth or other materials. Example vehicles include graders, backhoes, bulldozers, trenchers and scrapers. Skid steer loaders are commonly used for smaller grading and excavation jobs. Skid steer loaders are sold under brand names such as Bobcat® (trademark owned by Clark Equipment Company which is a subsidiary of Ingersoll-Rand) and the CASE 1800 Series (manufactured by CASE Corporation).

Skid steer loaders are multi-purpose machines that allow the operator to precisely control forward, rearward, up, down and lateral movement of the vehicle. Skid steer loaders can be fitted with a number of different attachments each being suited for a different function. Example attachments commonly used with skid steer loaders include augers, rakes, backhoes, buckets, dozer blades, pallet forks, tillers, stump grinders, trenchers, vibratory rollers as well as other attachments. U.S. Pat. Nos. 5,701,693; 5,775,438; 6,035,562; 6,283,225; 4,936,392 and 5,127,172 disclose skid steer loader attachments adapted for use in moving earth.

SUMMARY

One inventive aspect of the present disclosure relates to a multi-function grading implement. In certain embodiments, the grading implement is adapted for use with a skid steer loader.

Another inventive aspect of the present disclosure relates to an adapter for efficiently coupling an excavation implement to a skid steer loader. In one embodiment, the adapter allows the implement to be coupled to the skid steer loader in either a forward or reverse direction.

A further inventive aspect of the present disclosure relates to a method for transporting an oversized grading implement by positioning the grading implement on a trailer such that the grading implement extends between the wheels and beneath a skid steer loader positioned on the trailer.

Examples of a variety of inventive aspects in addition to those described above are set forth in the description that follows. It is to be understood that both the foregoing general description and the following detailed description are exemplary and explanatory only and are not restrictive of the broad inventive aspects that underlie the examples disclosed herein.

DETAILED DESCRIPTION

Figure 1:
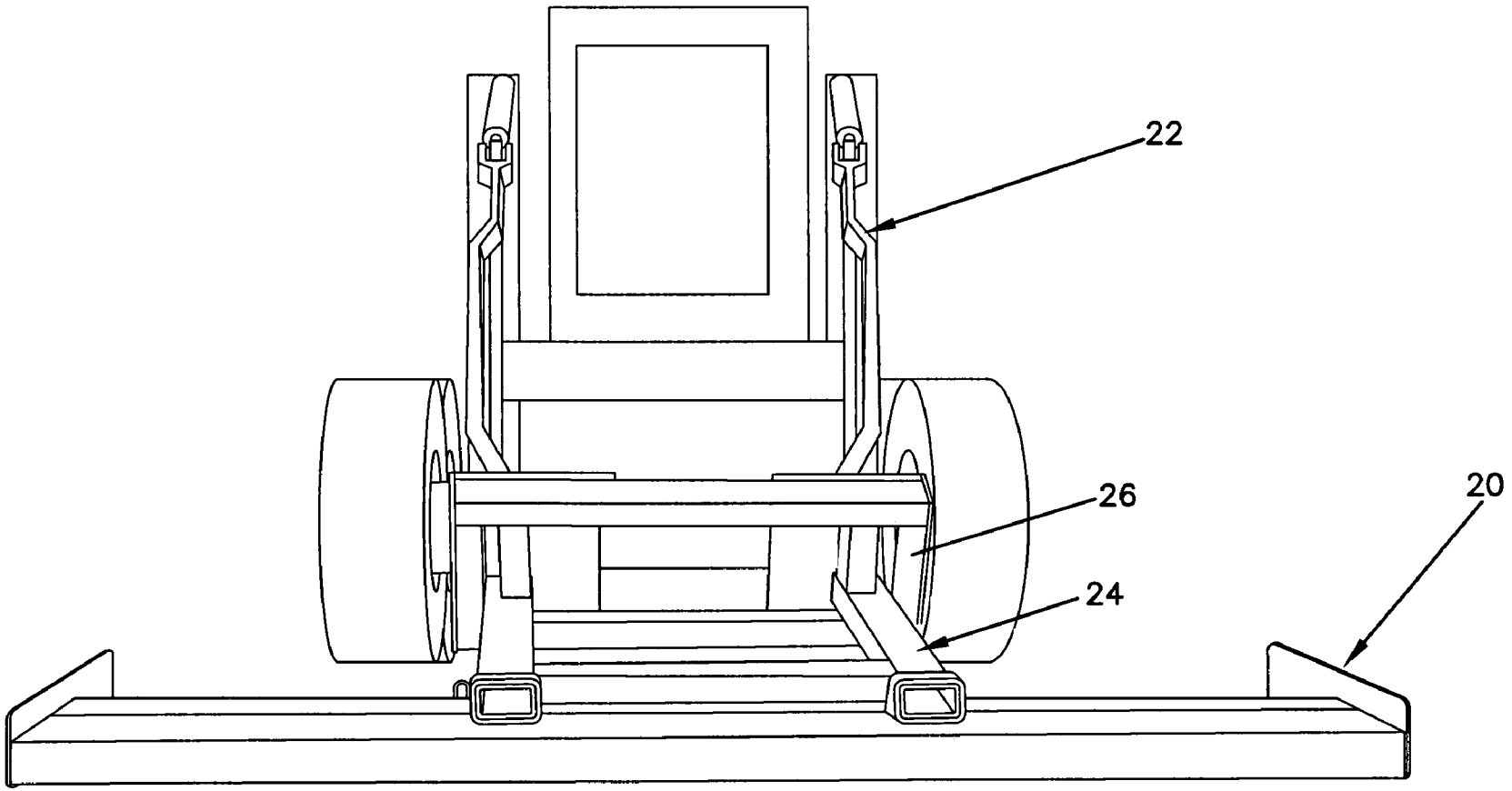
FIG. 1 is a front view of a skid steer loader with a grading implement in accordance with the principles of the present disclosure.
Figure 2:
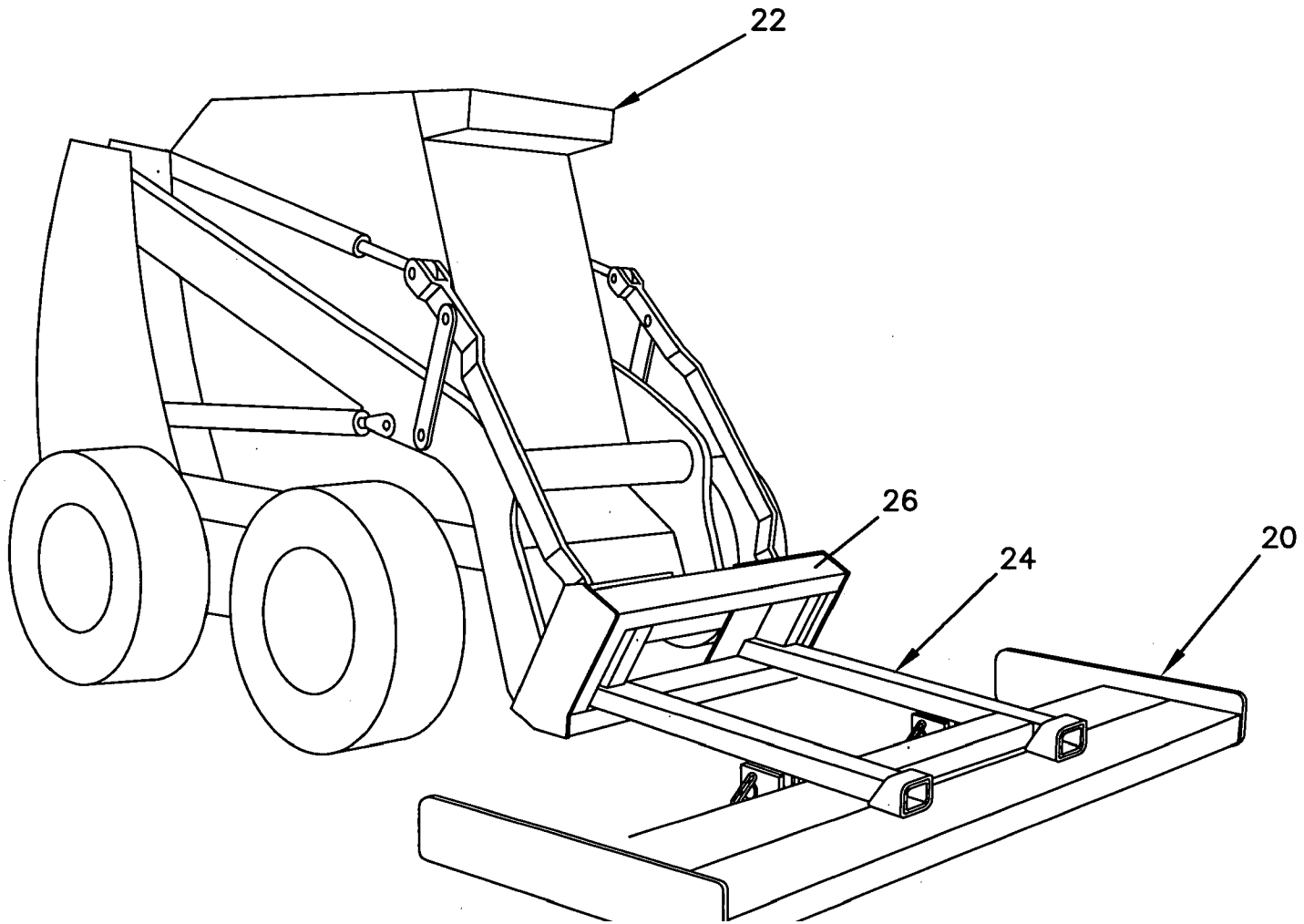
FIG. 2 is a front, side perspective view of the skid steer loader and grading implement of FIG. 1.
Figure 3:
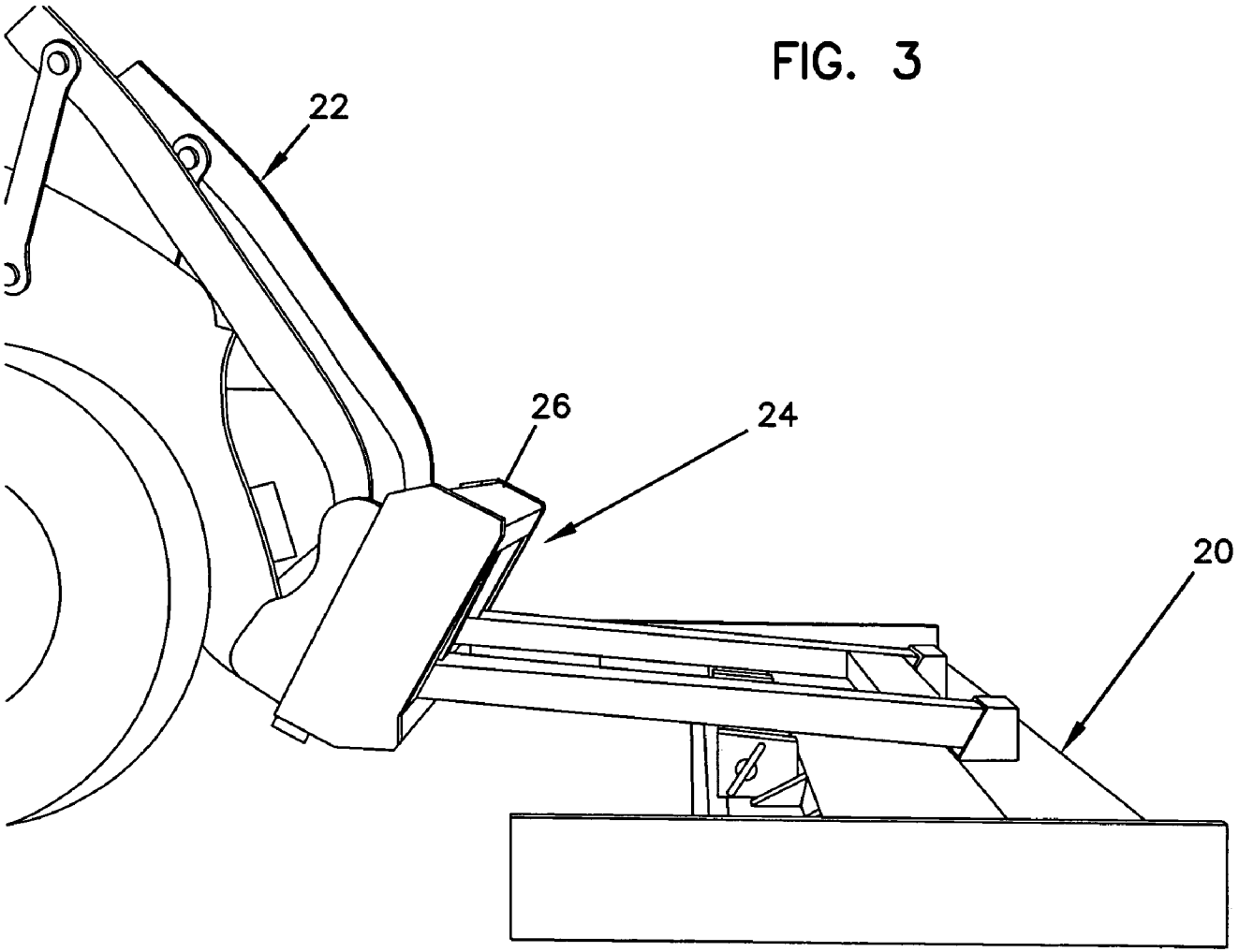
FIG. 3 is a side view of the skid steer loader and grading implement of FIGS. 1 and 2.

FIGS. 1-3 show an excavation implement 20 having features that are examples of inventive aspects in accordance with the principles of the present disclosure. The implement 20 is connected to a skid steer loader 22 by an intermediate adapter 24. The adapter 24 includes a quick-change coupler 26 that couples to an attachment structure that is conventionally provided as part of the skid steer loader 22.

Figure 4:
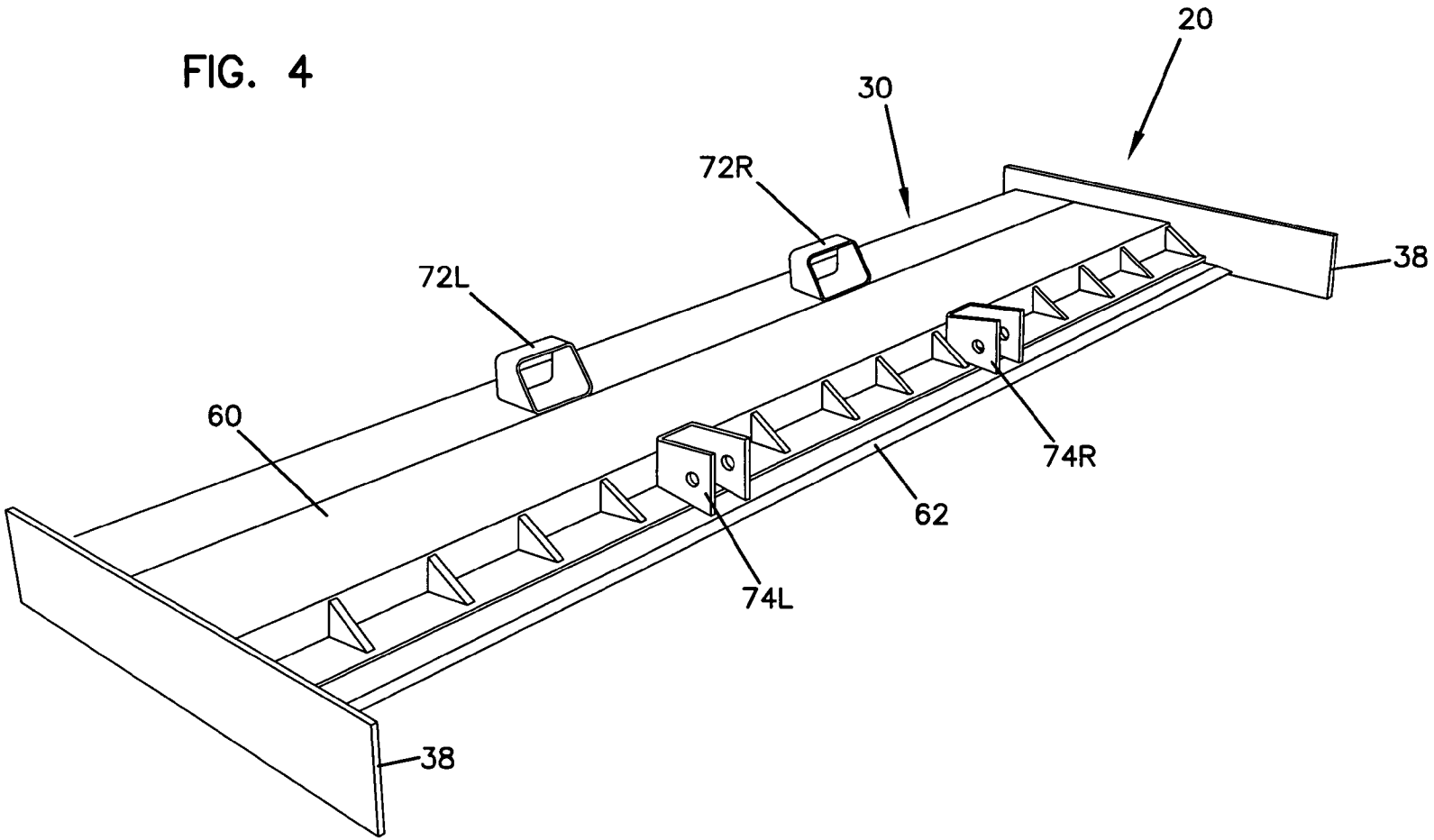
FIG. 4 is a rear perspective view of the grading implement of FIGS. 1-3.
Figure 5:
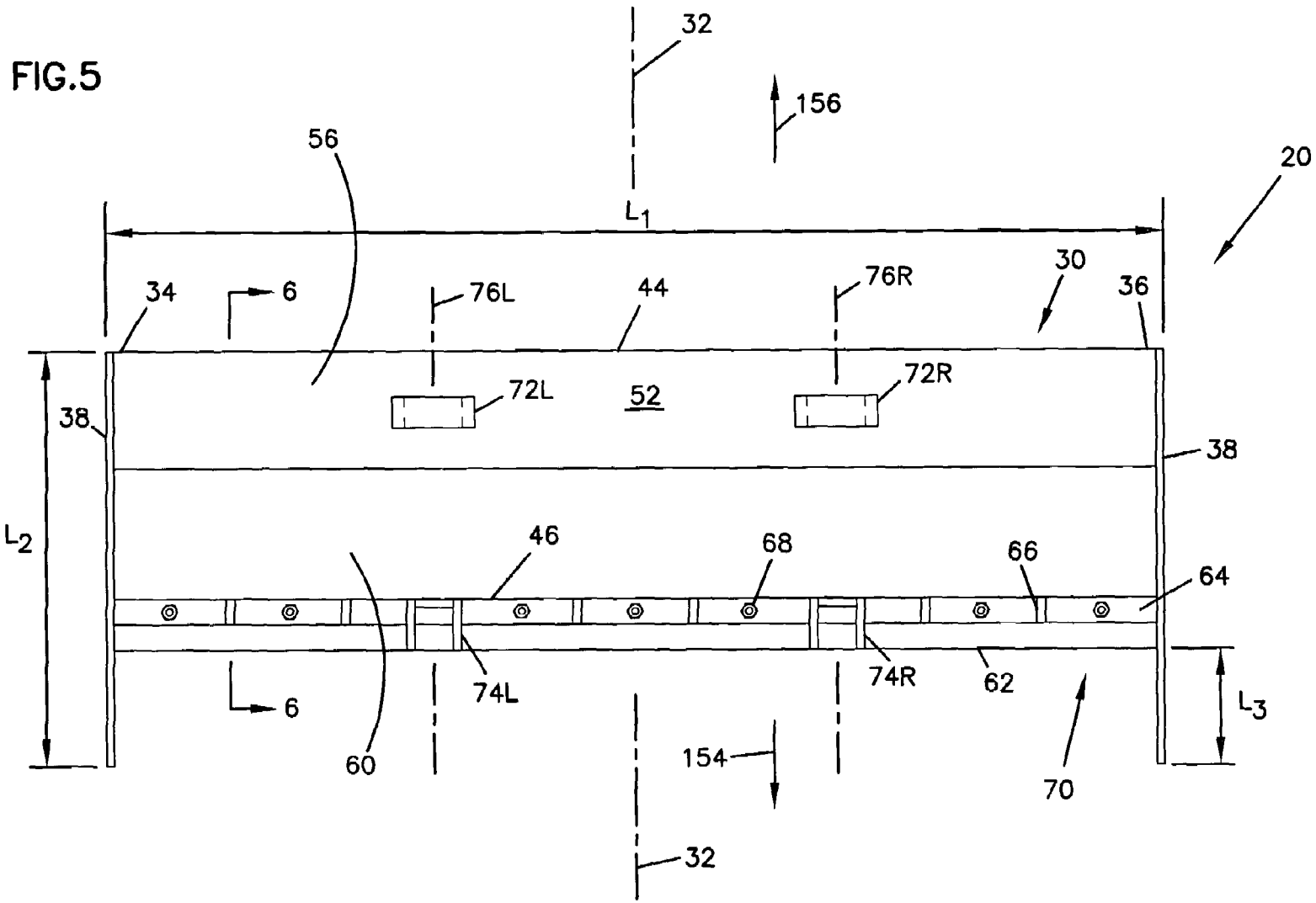
FIG. 5 is a top view of the grading implement of FIG. 4.
Figure 6:
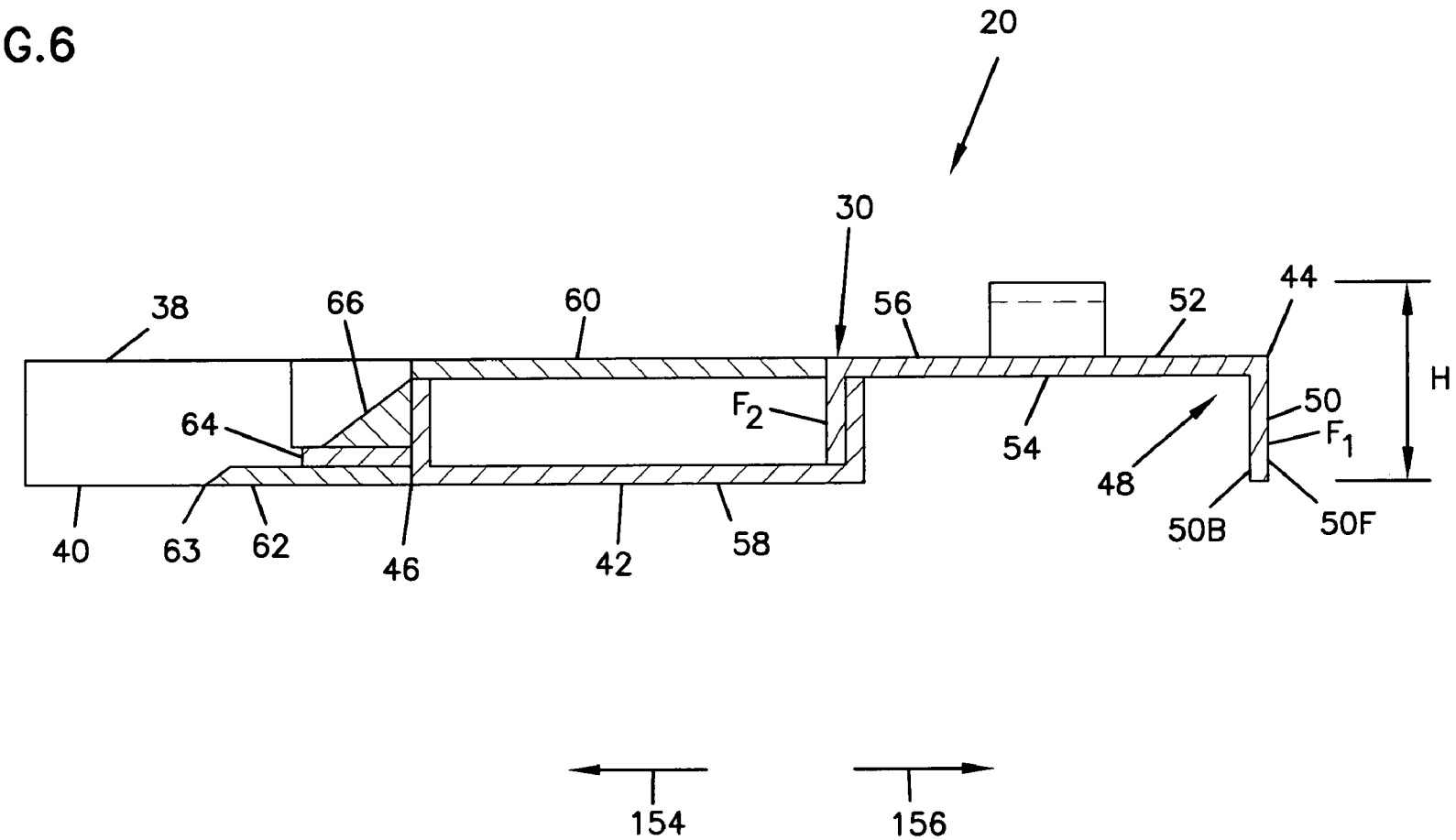
FIG. 6 is a cross-sectional view taken along section lines 6-6 of FIG. 5.

Referring to FIGS. 4-6, the implement 20 is shown disconnected from the adapter 24 and the skid steer loader 22. The implement 20 includes a main body 30 bisected by a central axis 32. The main body 30 includes a left end 34 positioned on one side of the central axis 32, and a right end 36 positioned on the opposite side of the central axis 32. End blades 38 are connected to the left and right ends 34, 36 of the main body 30. In one embodiment, the end blades 38 are welded to the ends 34, 36 of the main body 30. In alternative embodiments, the end blades 38 can be removably connected to the ends 34, 36 by conventional techniques such as fasteners.

As shown in FIG. 5, the end blades 38 preferably extend in a direction generally parallel to the central axis 32 of the blade 20. The end blades 38 are preferably aligned in generally vertical planes and have cutting edges 40 that are generally flush with a bottom side 42 of the main body 30 (see FIG. 6).

Referring again to FIG. 5, the main body 30 includes front and back sides 44, 46 that are generally perpendicular to the main axis 32 and that extend from the left end 34 to the right end 36 of the main body 30. As shown in FIG. 6, the front side 44 of the implement 20 defines a claw-blade 48 defined by a front blade 50 that projects vertically downwardly from a top wall 52 of the main body 30. The top wall 52 and the front blade 50 cooperate to define a cavity 54 for holding soil or other material excavated by a back side 50B of the front blade 50 when the excavation blade 20 is moved in a direction indicated by arrow 154. When the excavation blade 20 is moved in a direction indicated by arrow 156, a front face 50F of the front blade 50 can be used to push material in a manner similar to a conventional plow blade.

The claw action of the front blade 50 can be enhanced by tilting or pivoting the excavation blade 20 forwardly such that the front side 44 is lower than the back side 46. The claw blade 50 is particularly useful in spreading piles of material such as aggregate, base coarse or asphalt.

Referring now to FIG. 6, in one embodiment, the main body 30 is made by connecting two c-channels together in an interlock configuration. For example, FIG. 6 shows a first c-channel 56 welded to a second c-channel 58. The first c-channel 56 defines the cavity 54 adjacent the front blade 50. As shown at FIG. 6, the first c-channel 56 includes first and second flanges $F_1$, $F_2$ that extend downwardly from the top wall 52. The first flange $F_1$ forms the front plow blade 50. The cavity defined by the second c-channel 58 is covered by a top plate 60 that is welded to the main body 30. The c-channels 56, 58 are preferably made of a relatively hard material such as hardened steel.

Referring again to FIGS. 5 and 6, the excavation implement 20 also includes a rear blade 62 mounted to the back side 46 of the main body 30. The rear blade 62 is aligned in a generally horizontal plane and extends perpendicularly between the left and right ends 34, 36 of the main body 30. The rear blade 62 includes a cutting edge 63 that faces in a rearward direction. The rear blade 62 is connected to the back side 46 of the main body 30 by a mounting plate 64. The mounting plate is connected to the back side 46 of the main body 30 by conventional techniques such as a weld. Gussets 66 are provided to further reinforce the mounting plate 64. In the depicted embodiment, the rear blade 62 is removably connected to the mounting plate 64 by a conventional mounting technique such as fasteners 68.

The end blades 38 and the back side 46 of the main body 30 cooperate to define a volume 70 for holding material (e.g., aggregate, base coarse, asphalt) when the excavation implement 20 is moved in the direction indicated by arrow 154. When the excavation implement 20 is moved in the direction 154, the rear blade assists in scraping material into the volume 70, while the end blades 38 assist in preventing the material from inadvertently exiting the volume 70. It will be appreciated that the blades 38 are also useful in performing functions such as edging.

Referring to FIGS. 4 and 5, the excavation implement 20 also includes structures for allowing the adapter 24 to be removably coupled to the excavation implement 20. For example, the implement 20 includes left and right sleeves 72L and 72R mounted to the top wall 52 of the main body 30 on opposite sides of the central axis 32. The implement 20 also includes left and right pocket members 74L and 74R mounted to the mounting plate 64 on opposite sides of the central axis 32. As best shown in FIG. 5, the left sleeve 72L aligns with the left pocket 74L along an insertion line 76L, and the right sleeve 72R aligns with the right pocket 74R along a right insertion line 76R.

It will be appreciated that the excavation implement 20 can be manufactured to have any desired dimensions, with the dimensions being selected depending upon an intended use. In one non-limiting embodiment, the main body 30 has a length $L_1$ that is greater than 7 feet. In other embodiments, the length $L_1$ can be greater than 8 feet, greater than 9 feet, greater than 10 feet, or in the range of 10-15 feet. In other embodiments, the length $L_1$ can be about 7.6 feet or about 9.6 feet or about 12.6 feet. Still referring to FIG. 5, the side blades 38 can have a length greater than 25 inches, or greater than 30 inches, or greater than 35 inches. Still referring to FIG. 5, a length $L_3$ of the side blades 38 can be at least 3 inches, or at least 4 inches, or at least 5 inches, or at least 6 inches, or at least 7 inches, or at least 8 inches, or at least 9 inches, or at least 10 inches. Further, referring to FIG. 6, the implement 20 can have a height less than or equal to 10 inches. Moreover, the side blades 38 can have a height of at least 5 inches, or at least 6 inches, or at least 7 inches. While specific dimensions have been provided above, it will be appreciated that the specific dimensions identified above can be varied without departing from the principles of the present invention.

Figure 7:
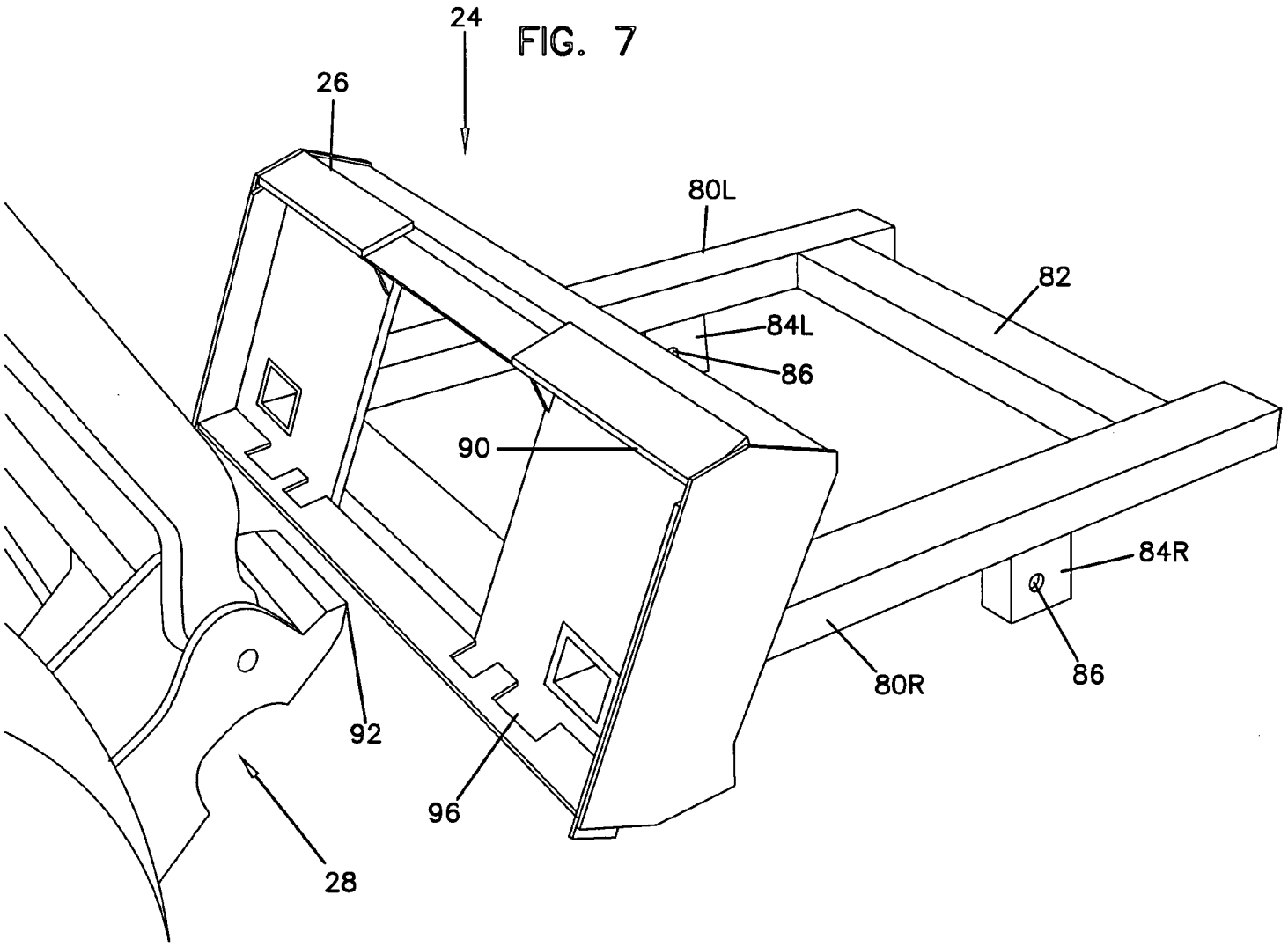
FIG. 7 is a perspective view of an adapter used to couple the grading implement of FIGS. 4-6 to the skid steer loader.

Referring now to FIG. 7, the adapter 24 is depicted. The adapter 24 includes the coupler 26, and two hollow extensions 80L, 80R that project forwardly from the coupler 26. The extensions 80L, 80R are preferably welded to the coupler 26, and are reinforced by a cross member 82. Posts 84L, 84R project downwardly from the extensions 80. The posts 84L, 84R define pinholes 86.

Referring now to FIG. 7, the coupler 26 of the adapter 24 preferably has a configuration adapted for coupling with a conventional attachment structure 28 of a skid steer loader. As depicted, the coupler 26 includes a top shoulder 90 for receiving a top link 92 of the attachment structure 28, and lower slots 96 for receiving latches 98 of the attachment structure 28. It will be appreciated that the coupler 26 and the attachment structure 28 can have any number of known configurations. Example coupling structures are disclosed in U.S. Pat. Nos. 5,974,706; 5,983,535; 5,562,397; 3,672,521 and 3,732,996, which are all incorporated herein by reference.

Figure 8:
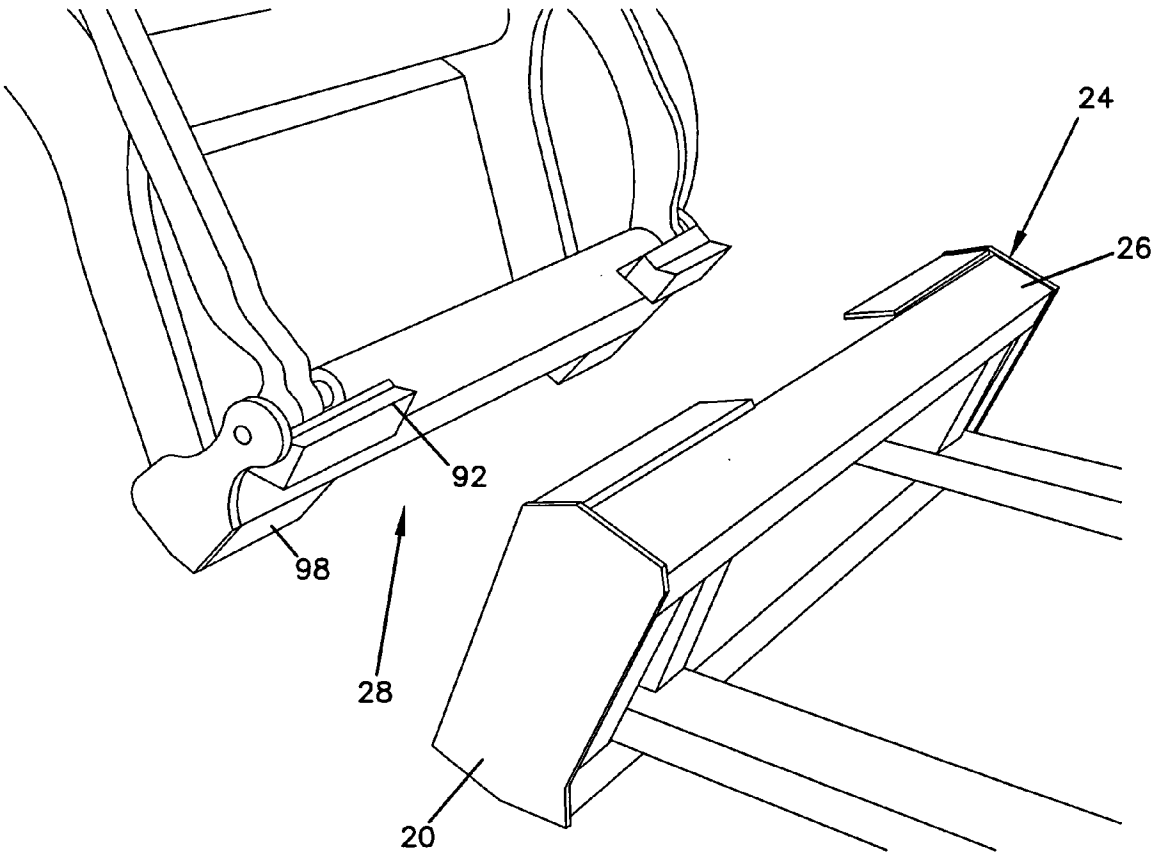
FIG. 8 shows a coupling structure of the adapter in alignment with an attachment structure of the skid steer loader.
Figure 9:
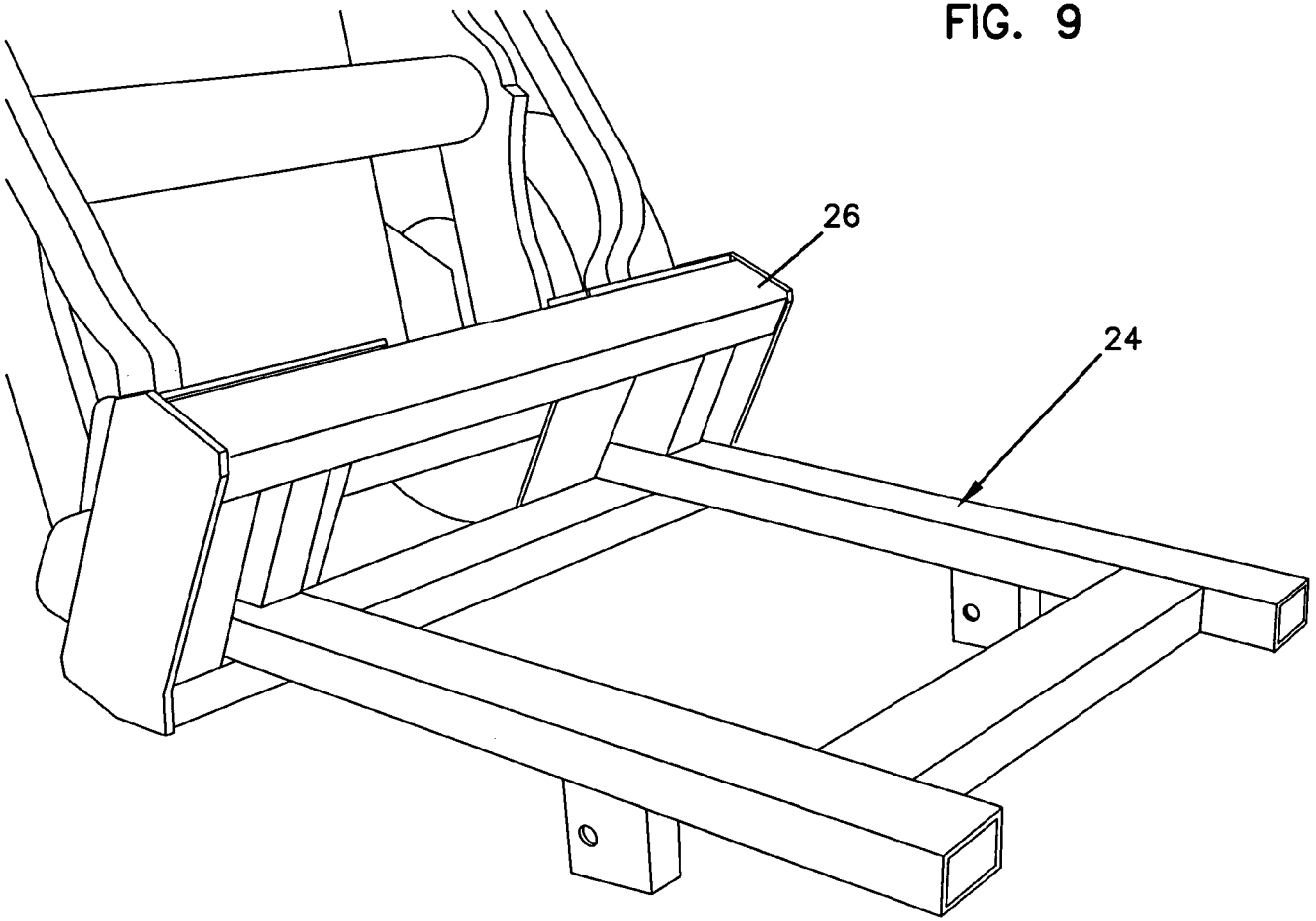
FIG. 9 shows the adapter coupled to the skid steer loader.
Figure 10:
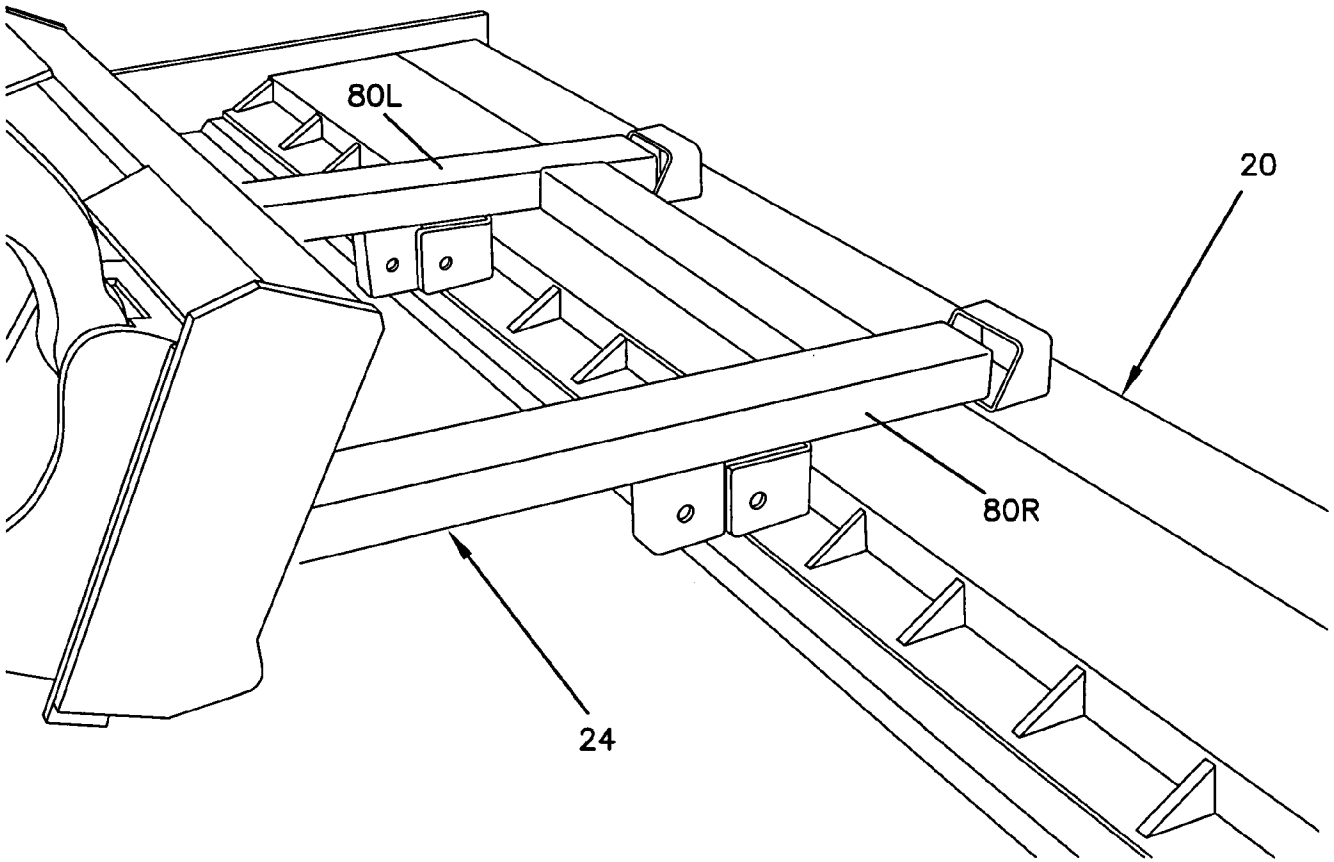
FIG. 10 shows the adapter in alignment with the grading implement of FIGS. 4-6.
Figure 11:
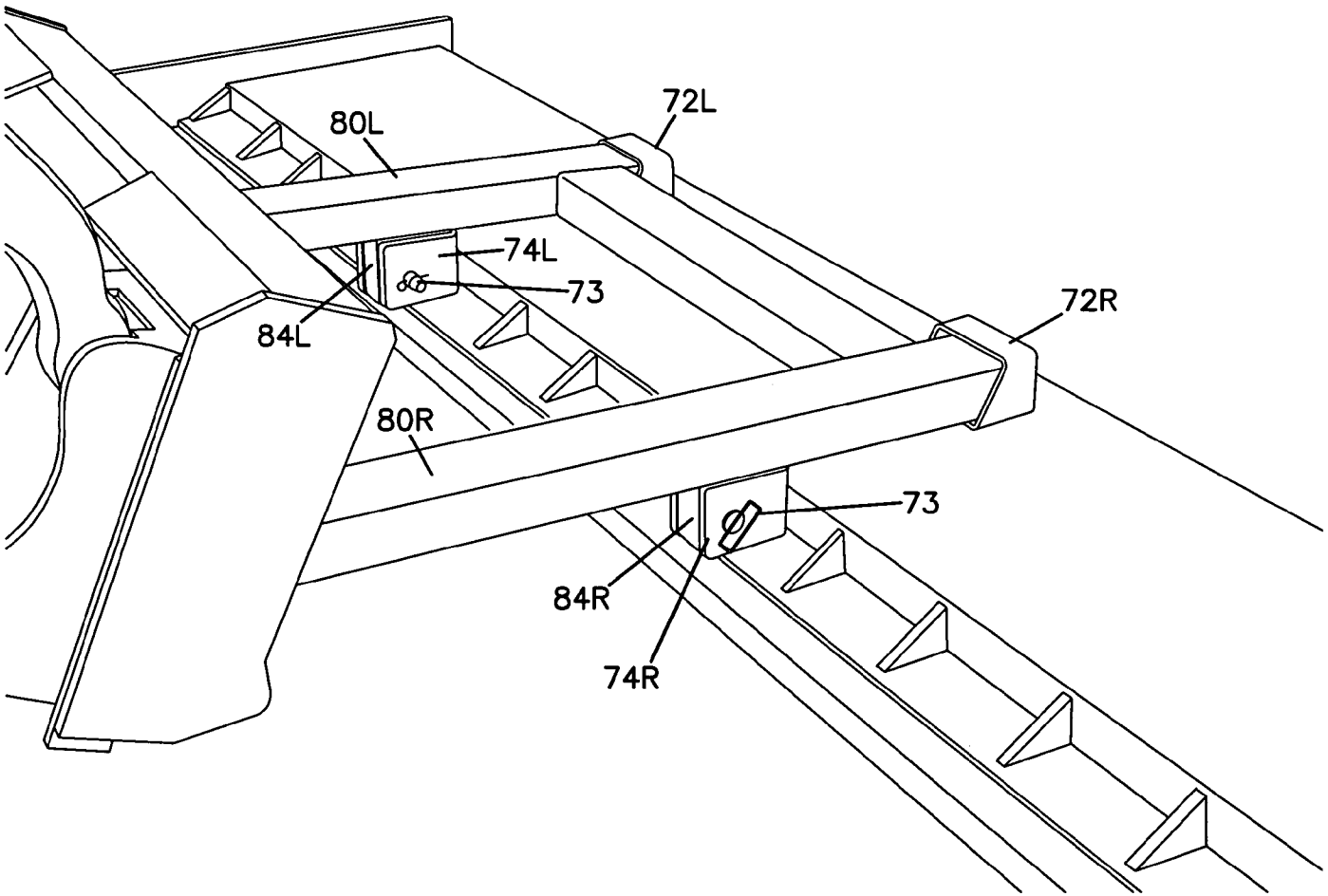
FIG. 11 shows the adapter coupled to the grading implement of FIGS. 4-6.
Figure 12:
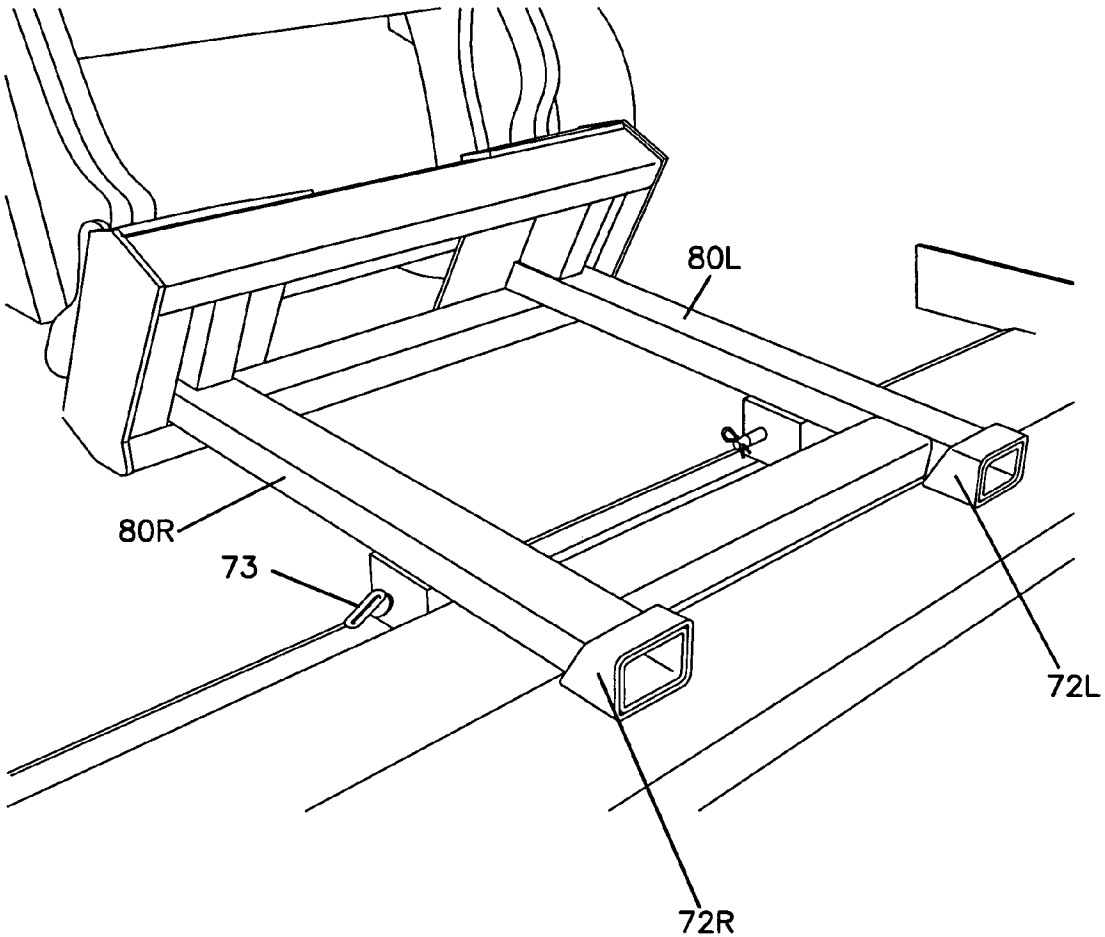
FIG. 12 shows the adapter coupled to the grading implement of FIGS. 4-6.

Referring to FIGS. 7 and 8, the attachment structure 28 of the skid steer loader 22 is shown adjacent to the coupler 26 of the adapter 24. Referring to FIG. 9, the attachment structure 28 is shown coupled with the coupler 26. Referring to FIG. 10, the extensions 80L, 80R of the adapter 24 are shown respectively aligned with the lines of insertion 76L, 76R of the excavation implement 20. FIGS. 11 and 12 show the adapter 24 coupled with the excavation implement 20. As so coupled, the extensions 80L, 80R are respectively received within the sleeves 72L, 72R, and the posts 84L, 84R are respectively received within the pockets 74L, 74R. Locking pins 73 (e.g., cotter pins) are inserted through the pockets 74L, 74R, and the pin holes 86 of the posts 84L, 84R to prevent the adapter 24 from unintentionally disengaging from the excavation implement 20.

Figure 13:
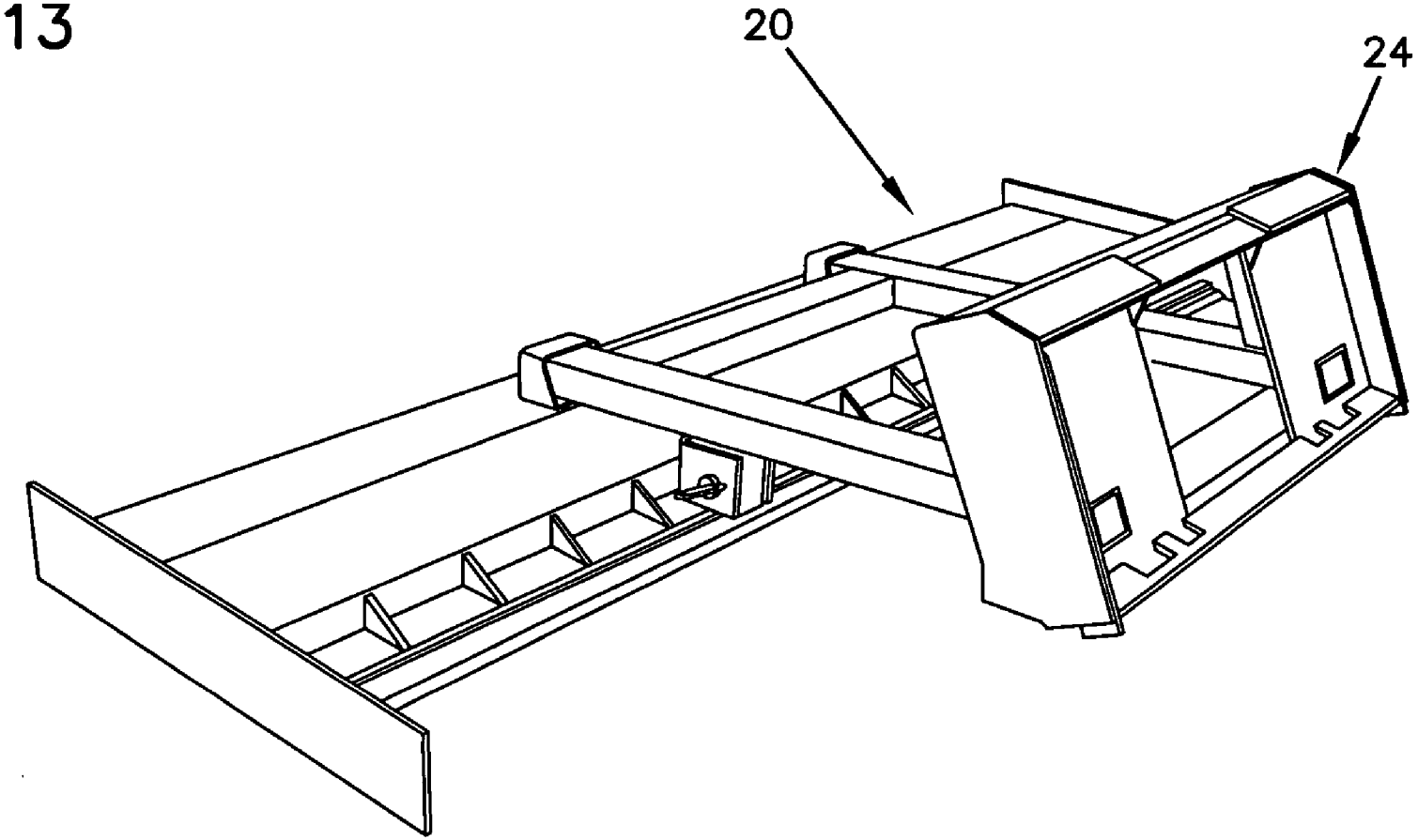
FIG. 13 shows the adapter coupled to the grading implement of FIGS. 4-6 and disconnected from the skid steer loader.
Figure 14:
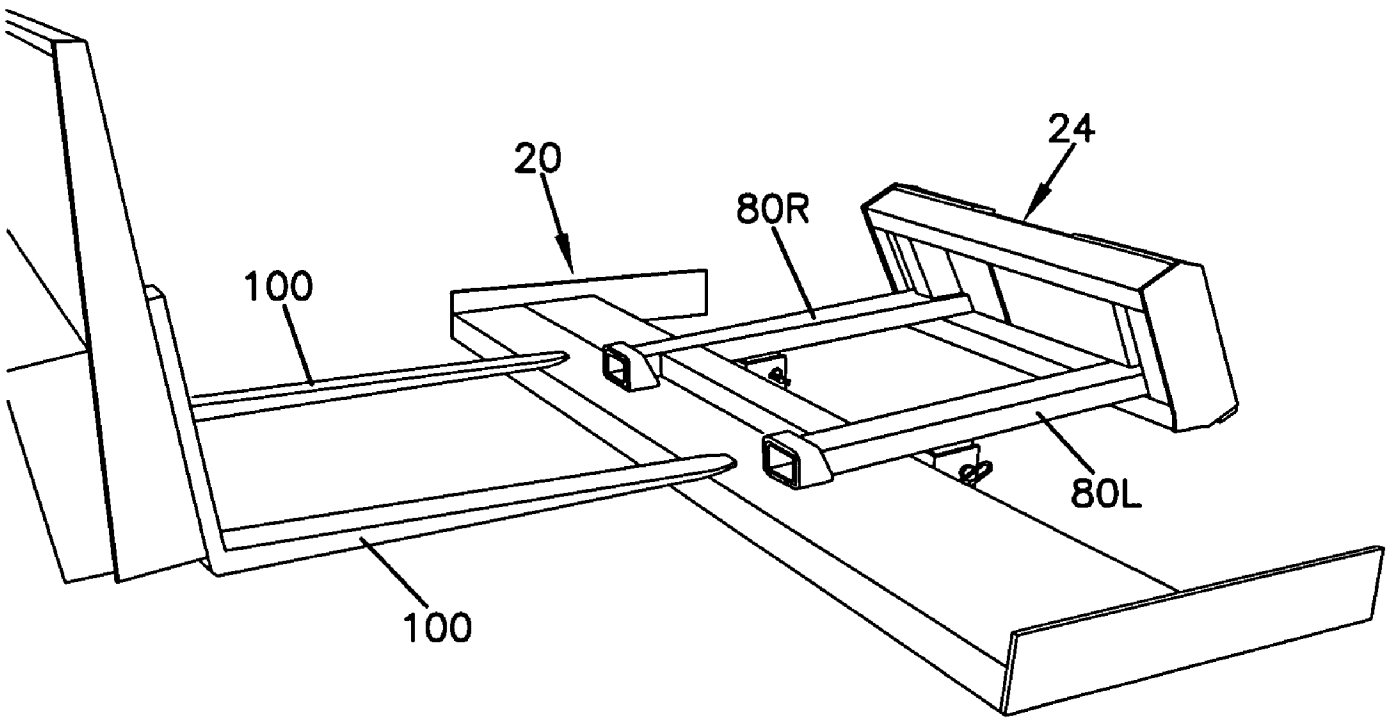
FIG. 14 shows the skid steer loader equipped with forks which are oriented in alignment with receiving tubes of the adapter.
Figure 15:
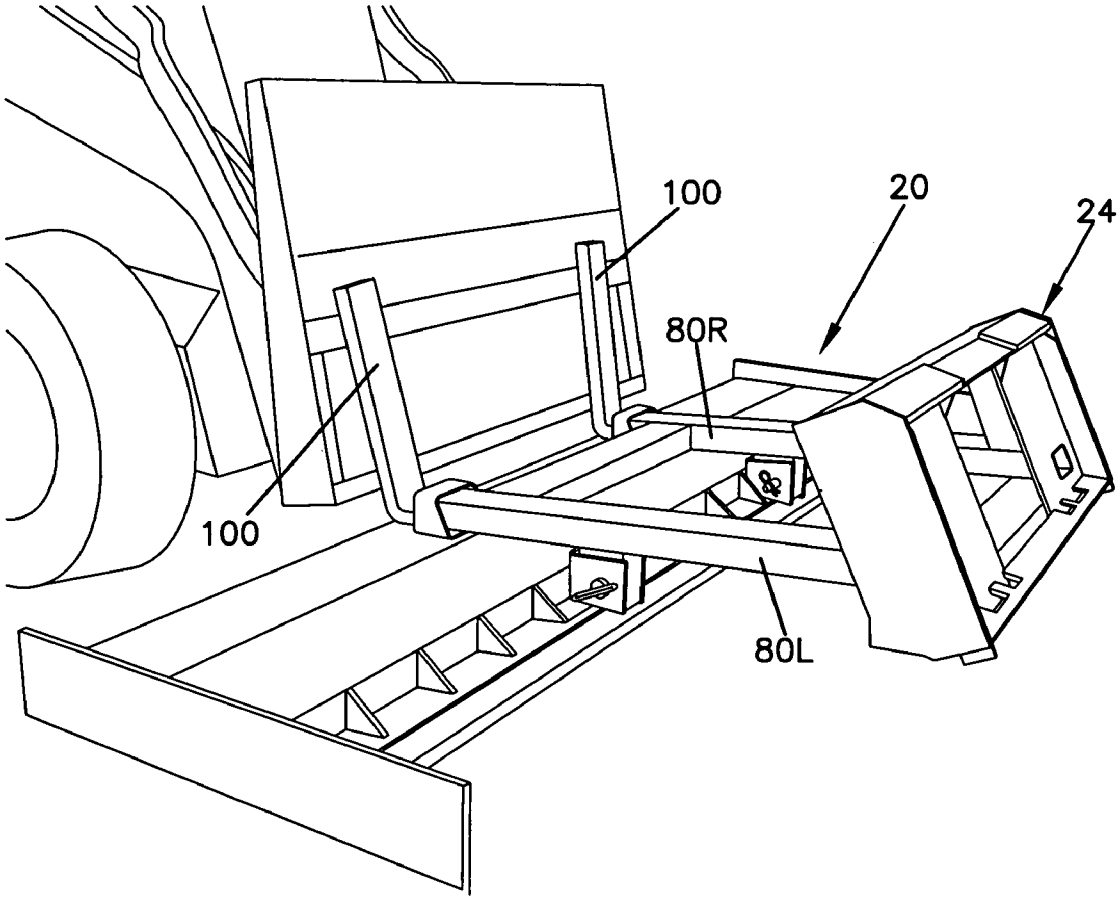
FIG. 15 shows the forks of the skid steer loader inserted within the receiving tubes of the adapter.

The adapter 24 also allows the implement 20 to be reverse mounted on the skid steer loader 22. This is accomplished by first disconnecting the coupler 26 from the skid steer loader 22 as shown in FIG. 13. Then, forks 100 are coupled to the skid steer loader 22. Next, skid steer loader 22 is positioned such that the forks 100 align with the extensions 80L, 80R of the adapter 24 (see FIG. 14). After alignment, the forks 100 are inserted within the extensions 80L, 80R of the adapter 24 such that the excavation implement 20 is mounted to the skid steer loader 22 in a backward or a reverse direction as shown in FIG. 15.

Figure 16:
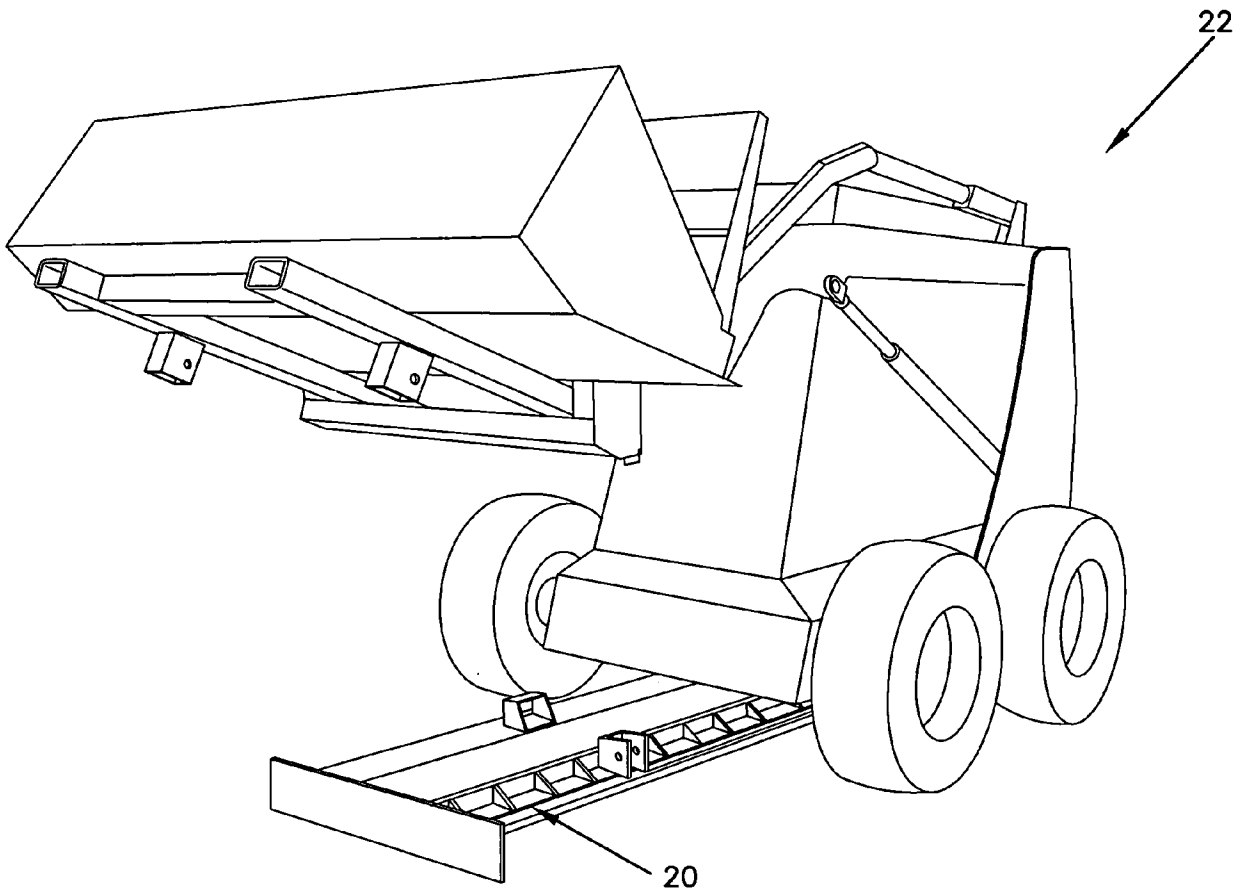
FIG. 16 shows the grading implement of FIGS. 4-6 positioned beneath the skid steer loader.
Figure 17:
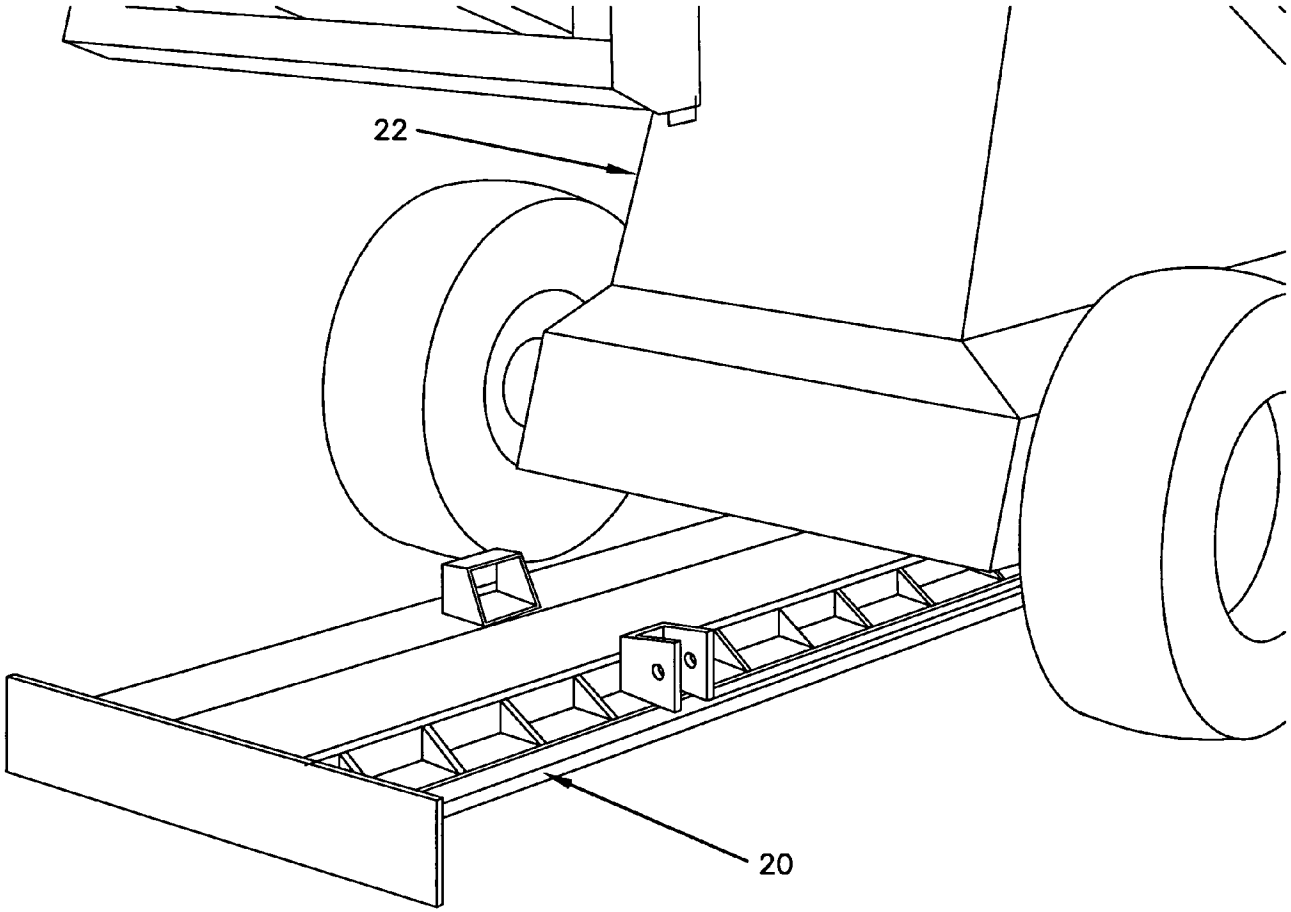
FIG. 17 is an enlarged view of the grading implement of FIGS. 4-6 positioned beneath the skid steer loader.

It is contemplated that the length $L_1$ of the main body 30 can be oversized in certain embodiments. This can present problems when transporting the excavation implement 20 from job site to job site on a trailer suited for carrying the skid steer loader 22. If the excavation implement 20 remains mounted on the skid steer loader 22 during transport, the length of the excavation implement 20 will cause the excavation implement 20 to hang over the edges of the trailer. To overcome this problem, it is desirable for the excavation implement 20 to be sized such that the skid steer loader 22 can drive over the excavation implement 20 as shown in FIGS. 16 and 17. Thus, it is preferred for the length of the side blades 38 to be shorter than the distance between the left and right wheels of the skid steer loader 22. It is also preferred for the height H of the excavation implement 20 to be shorter than the clearance height of the skid steer loader 22. The depicted skid steer loader is a CASE 90XT loader having a middle clearance height of about 9.5 inches and a spacing between left and right wheels of about 54 inches. Thus, it is preferred for the grading implement 20, without the adapter 24, to have a maximum height less than 9.5 inches and a maximum width less than 54 inches. Of course, different sizes can be provided to correspond to different models and brands of skid steer loaders. To provide the skid steer with greater clearance height, the skid steer can be packed with the tires resting on risers such as planks.

The ability of the excavation implement 20 to be stored beneath the skid steer loader 22 as shown in FIGS. 16 and 17 is enhanced by the removable adapter 24. Further, as shown in FIG. 16, the adapter 24 can be used to transport a bucket loader. Moreover, during transport, forks can be inserted into the extensions 80 of the adapter 24 to further simplify transport.

While some of the implement components have been described as being welded together, it will be appreciated that any of the components could also be fastened together with fasteners (e.g., bolts) to facilitate the replacement of worn or broken parts.

With regard to the foregoing description, it is to be understood that changes may be made in detail, especially with respect to the shape, size and arrangement of the parts. It is intended that the specification and depicted features be considered illustrative only and not limiting with respect to the broad underlying concepts of the present disclosure.

What is claimed is:

1. A grading implement comprising:

a main body including a left end, a right end and a length that extends between the left and right ends, the main body also including a front and a back, the main body further including a first channel member having a length that extends between the left and right ends of the main body, the first channel member including a top wall and first and second spaced-apart flanges that extend downwardly from the top wall, the top wall and the first and second flanges extending along the length of the first channel member, the first flange of the first channel member being located at the front of the main body and the second flange being rearwardly spaced from the first flange, the first flange forming at least a portion of a front plow blade that extends between the left and right ends of the main body, and the first channel member also including an open bottom side;

end plates positioned at the left and right ends of the main body, the end plates including portions that extend rearwardly beyond the main body so as to define a volume behind the main body between the end plates, the volume being adapted for receiving grading material when the implement is moved rearwardly;

a rear blade positioned at the back of the main body, the rear blade having a cutting edge that faces in a rearward direction, and the rear blade having a length that extends between the end plates; and wherein the main body further includes a second channel member having a length that extends between the left and right ends of the main body, the second channel member being positioned behind the first channel member, wherein the rear blade is positioned adjacent the second channel member.

2. The implement of claim 1, further comprising means for coupling the implement to an attachment structure provided on the front lift arms of a skid steer loader.

3. The implement of claim 1, wherein the end plates are oriented in generally vertical planes, wherein the end plates are generally perpendicular relative to the length of the main body, and wherein the end plates include portions that extend upwardly higher than a top surface of the main body.

4. A grading implement comprising:

a main body including a left end, a right end and a length that extends between the left and right ends, the main body also including a front and a back, the main body further including a first channel member having a length that extends between the left and right ends of the main body, the first channel member including a top wall and first and second spaced-apart flanges that extend downwardly from the top wall, the top wall and the first and second flanges extending along the length of the first channel member, the first flange of the first channel member being located at the front of the main body and the second flange being rearwardly spaced from the first flange, the first flange forming at least a portion of a front plow blade that extends between the left and right ends of the main body, and the first channel member also including an open bottom side;

end plates positioned at the left and right ends of the main body, the end plates including portions that extend rearwardly beyond the main body so as to define a volume behind the main body between the end plates, the volume being adapted for receiving grading material when the implement is moved rearwardly;

a rear blade positioned at the back of the main body, the rear blade having a cutting edge that faces in a rearward direction, and the rear blade having a length that extends between the end plates; and wherein bottoms of the end plates are generally flush with a bottom side of the main body, and are also generally flush with the cutting edge of the rear blade.

5. The implement of claim 1, wherein the end plates are oriented in generally vertical planes, and wherein the side blades are oriented generally perpendicular relative to the length of the main body.

6. The implement of claim 1, wherein the end plates each extend rearwardly beyond the main body by a length of at least 3 inches, and each of the end plates has a height of at least 5 inches.

7. The implement of claim 1, wherein the end plates each extend rearwardly beyond the main body by a length of at least 6 inches, and each of the end plates has a height of at least 5 inches.

8. A grading implement comprising:

a main body including a left end, a right end and a length that extends between the left and right ends, the main body also including a front and a back, the main body further including a first channel member having a length that extends between the left and right ends of the main body, the first channel member including a top wall and first and second spaced-apart flanges that extend downwardly from the top wall, the top wall and the first and second flanges extending along the length of the first channel member, the first flange of the first channel member being located at the front of the main body and the second flange being rearwardly spaced from the first flange, the first flange forming at least a portion of a front plow blade that extends between the left and right ends of the main body, and the first channel member also including an open bottom side;

end plates positioned at the left and right ends of the main body the end plates including portions that extend rearwardly beyond the main body so as to define a volume behind the main body between the end plates, the volume being adapted for receiving grading material when the implement is moved rearwardly;

a rear blade positioned at the back of the main body, the rear blade having a cutting edge that faces in a rearward direction, and the rear blade having a length that extends between the end plates; and wherein the rear blade extends generally perpendicularly between the end plates and includes a generally horizontal bottom surface and a beveled top surface, the beveled top surface angling upwardly as the beveled top surface extends forwardly from the cutting edge of the rear blade.

9. The implement of claim 1, further comprising an adapter including a coupler configured to be coupled to a vehicle, the adapter being detachably connectable to the main body of the implement by removable pins.

10. The implement of claim 1, further comprising an adapter including coupling means for coupling the adapter to an attachment structure of a skid steer loader, the adapter also including first and second generally parallel extensions that project outwardly from the coupling means, the adapter further including posts that project downwardly from the first and second extensions, the posts being detachably connected to the main body of the implement by removable pins, the extensions being configured to slide within sleeves positioned at a top side of the main body.

11. A grading implement comprising:

a main body including a left end and a right end, the main body also including a length that extends between the left and right ends, the main body further including a front and a back;

a front plow blade positioned at the front of the main body, the front plow blade extending between the left and right ends of the main body and including a front surface for pushing grading material and a back surface for dragging grading material;

the main body defining a cavity located beneath the main body and positioned behind the front plow blade; and side blades positioned at the left and right ends of the main body, the side blades including portions that extend rearwardly beyond the main body so as to define a volume behind the main body between the side blades, the volume being adapted for receiving grading material when the implement is moved rearwardly;

an adapter including a coupler configured to be coupled to a vehicle, the adapter being detachably connectable to the main body of the implement;

the adapter including at least a pair of extensions, and the implement including sleeves mounted to the main body for receiving the extensions;

wherein the extensions are hollow and sized to receive tines of the vehicle for allowing the implement to be reverse mounted to the vehicle.

12. The implement of claim 10, wherein the first and second extensions are hollow and sized to receive tines of the vehicle for allowing the implement to be reverse mounted to the vehicle.

13. The implement of claim 1, wherein the length of the main body is at least 7 feet.

14. The implement of claim 1, wherein the length of the main body is at least 10 feet.

15. The implement of claim 1, wherein the end plates each have a height of at least 5 inches.

16. The implement of claim 1, wherein the end plates each extend rearwardly beyond the main body by a length of at least 3 inches.

17. The implement of claim 1, wherein the end plates each extend rearwardly beyond the main body by a length of at least 6 inches.

18. The implement of claim 1, wherein the first channel member has a generally C-shaped cross-section.

19. The implement of claim 1, further comprising an adapter for coupling the main body of the implement to a skid steer loader, the adapter being detachable from the main body of the implement, wherein when the main body of the implement is detached from the adapter, the main body defines a maximum height less than 9.5 inches and a maximum width less than 54 inches.

20. A grading implement comprising:

a main body including a left end and a right end, the main body also including a length that extends between the left and right ends, the main body further including a front and a back, the main body also including a c-channel member that extends from the left end to the right end of the main body, the c-channel member defining a downwardly facing channel;

the c-channel member forming at least a portion of a front plow blade positioned at the front of the main body, the front plow blade extending between the left and right ends of the main body and including a front surface for pushing grading material and a back surface for dragging grading material;

end plates positioned at the left and right ends of the main body, the end plates including portions that extend rearwardly beyond the main body so as to define a volume behind the main body between the end plates, the volume being adapted for receiving grading material when the implement is moved rearwardly;

a rear blade positioned at the back of the main body, the rear blade having a cutting edge that faces in a rearward direction, and the rear blade having a length that extends between the end plates; and a connection arrangement for coupling the main body of the grading implement to a skid steer loader, the connection arrangement including means for interfacing with an attachment structure provided on the front lift arms of a skid steer loader.

21. The grading implement of claim 20, wherein the front plow blade and the rear blade are not pivotally movable relative to the end plates.

22. The grading implement of claim 20, wherein bottoms of the end plates are generally flush with the cutting edge of the rear blade and a bottom edge of the front plow blade.

23. The grading implement of claim 20, wherein the main body is detachable from the connection arrangement.

24. The grading implement of claim 23, wherein the main body is connected to the connection arrangement by cotter pins.

25. The grading implement of claim 23, wherein when the main body of the implement is detached from the connection arrangement, the main body defines a maximum height less than 9.5 inches and a maximum width less than 54 inches.

26. The grading implement of claim 20, wherein the end plates are oriented in generally vertical planes, wherein the end plates are generally perpendicular relative to the length of the main body, and wherein the end plates include portions that extend upwardly higher than a top surface of the main body.

27. The grading implement of claim 20, wherein the end plates each extend rearwardly beyond the main body by a length of at least 3 inches, and each of the end plates has a height of at least 5 inches.

28. The grading implement of claim 20, wherein the end plates each extend rearwardly beyond the main body by a length of at least 6 inches, and each of the end plates has a height of at least 5 inches.

29. The grading implement of claim 20, wherein the rear blade extends generally perpendicularly between the end plates and includes a generally horizontal bottom surface and a beveled top surface, the beveled top surface angling upwardly as the beveled top surface extends forwardly from the cutting edge of the rear blade.

30. The grading implement of claim 29, wherein bottoms of the end plates are generally co-planar with the horizontal bottom surface of the rear blade and are also generally co-planar with the a bottom edge of the front plow blade.

* * * * *